United States Patent [19]

Masuno et al.

[11] 4,299,652

[45] Nov. 10, 1981

[54] PROCESS FOR RECOVERY OF PULP MILL CHEMICALS

[75] Inventors: Kouji Masuno; Junji Nakayama, both of Yokohama; Yukio Mizoguchi, Tokyo; Mitsuyoshi Kaneko, Machida, all of Japan

[73] Assignee: Ebara Corporation, Tokyo, Japan

[21] Appl. No.: 127,889

[22] Filed: Mar. 5, 1980

Related U.S. Application Data

[63] Continuation of Ser. No. 929,502, Jul. 31, 1978, abandoned.

[51] Int. Cl.[3] ..... D21C 11/04; D21C 11/08; D21C 11/12

[52] U.S. Cl. ..... 162/30 K; 55/73; 162/51; 423/207; 423/221; 423/242; 423/514; 423/DIG. 3

[58] Field of Search ..... 162/29, 30 R, 30 K, 162/51; 423/220, 221, 225, 232, 234, 242, 514, DIG. 3, 206, 207; 55/73

[56] References Cited

U.S. PATENT DOCUMENTS

| | | | |
|---|---|---|---|
| 3,183,145 | 5/1965 | Collins | 162/51 |
| 3,471,249 | 10/1969 | Markant et al. | 423/220 |
| 3,554,859 | 1/1971 | Murray | 162/51 |
| 3,752,875 | 8/1973 | O'Hern et al. | 423/DIG. 3 |
| 4,053,352 | 10/1977 | Hultman et al. | 162/30 K |

FOREIGN PATENT DOCUMENTS

| | | | |
|---|---|---|---|
| 529238 | 8/1956 | Canada | 423/514 |
| 50-58301 | 5/1975 | Japan | 162/51 |

OTHER PUBLICATIONS

Oloman et al., "The Selective Absorption of Hydrogen Sulfide from Stack Gas", Pulp & Paper Magazine of Canada, Dec. 5, 1969, pp. 69–74.

*Primary Examiner*—Peter F. Kratz
*Attorney, Agent, or Firm*—Oblon, Fisher, Spivak, McClelland & Maier

[57] ABSTRACT

A process is disclosed in which a waste gas containing sulfur compounds and carbon dioxide from pulp mill is contacted with an aqueous alkali solution derived from green liquor, white liquor or weak white liquor having low pH value and low sodium ion concentration and having been oxidized, whereby the sulfur compounds are absorbed as completely as possible with minimal absorption of carbon dioxide in the waste gas.

10 Claims, 2 Drawing Figures

PROCESS FOR RECOVERY OF PULP MILL CHEMICALS

Figure 1:
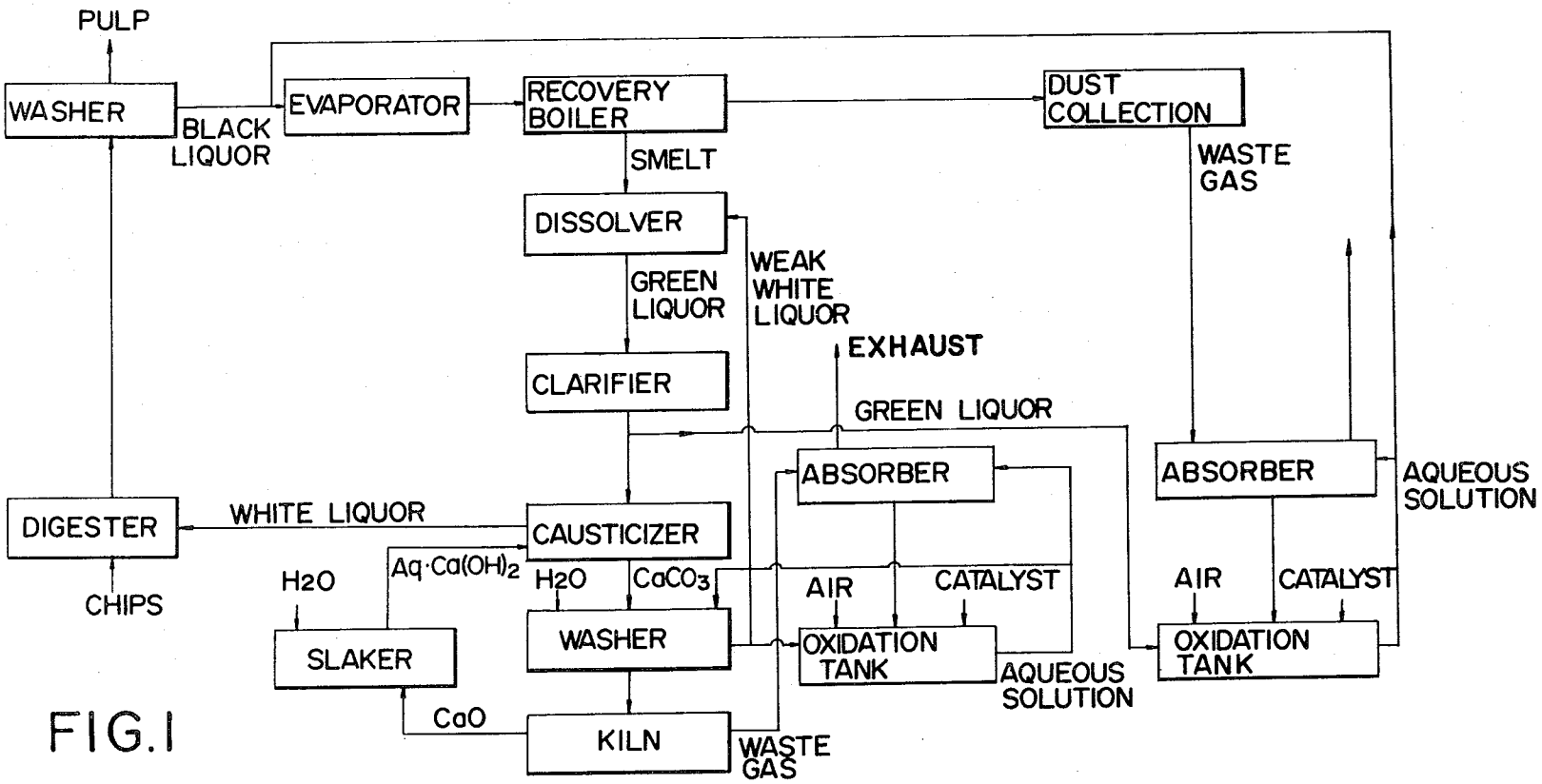

This is a continuation of application Ser. No. 929,502, filed July 31, 1978, now abandoned.

This invention relates to a process for recovery of pulp mill chemicals and, more particularly, to a process comprising contacting a waste gas containing sulfur compounds and dust with an aqueous alkaline solution.

Recently, the government standards for permissible concentrations of dust and sulfur compounds in exhausts from various mills have become more strict. It is necessary therefore to reduce the amount of various pollutants such as dust, sulfur oxides and hydrogen sulfide present in exhaust gases from various sources in pulp mill, for example, a recovery boiler, a kiln calcinating calcium carbonate and a heavy oil boiler. The conventional way is to contact such exhaust gases with an aqueous alkaline solution and the alkaline solution washings are usually discarded after neutralization. This results in the loss of valuable chemicals. Therefore, it is desirable to reuse the alkaline solution washings in the pulp mill.

However, washing of the exhaust gas with a fresh aqueous alkaline solution and circulating it to the pulp mill chemicals are undesirable, because the additional aqueous alkaline solution will disturb the balance of chemicals circulating through the pulp mill.

In this connection, it will be advantageous to use an aqueous alkaline solution, which is used in or supplied from a pulp mill, for washing the exhaust gas. In the pulp mill, the aqueous alkaline solution is circulated in the form of green liquor, white liquor and weak white liquor which are alternating through the chemical recovery treatment. Their typical compositions, in terms of mol/l, are as follows.

| | Green liquor | White liquor | Weak white liquor |
|---|---|---|---|
| $Na_2CO_3$ | 1.1 | 0.2 | 0.04 |
| NaOH | — | 0.9 | 0.43 |
| $Na_2S$ | 0.3 | 0.3 | 0.06 |
| $Na_2S_2O_3$ | 0.02 | — | — |
| $Na_2SO_3$ | 0.01 | — | — |
| pH | 13–14 | 13–14 | 13–14 |

Unfortunately, because of their high concentration of sodium sulfide, upon contacting them with a waste gas containing carbon dioxide, there is often observed liberation of hydrogen sulfide and therefore it is impossible to use such green liquor, white liquor or weak white liquor for absorption of hydrogen sulfide and sulfur dioxide in the waste gas.

We have found that, when a green liquor, a white liquor or a weak white liquor is contacted with air in the presence of a water soluble iron salt under specific conditions, sodium sulfide in the liquor is oxidized to convert it into sodium thiosulfate and/or sodium sulfate which are not decomposed into hydrogen sulfide upon contacting them with carbon dioxide.

Therefore, an object of this invention is to provide a process for recovery of pulp mill chemicals which comprises the following steps; (a) contacting a molecular oxygen-containing gas with an aqueous alkaline solution selected from the group consisting of green liquor, white liquor and weak white liquor under the conditions of a pH of from 8.3 to 9.0, a temperature of from 20° to 95° C. and a sodium ion concentration of from 0.1 to 1.0 mol/l in the presence of a catalytic amount of at least one water soluble iron salt, (b) absorbing an exhaust gas containing sulfur compounds, carbon dioxide and dust, for example, from a recovery boiler, a kiln calcinating calcium carbonate and a heavy oil boiler, in the oxidized liquor from step (a), and (c) returning the liquor from step (b) to an aqueous pulp mill chemical.

Thus, valuable sulfur compounds, sodium compounds and/or calcium compounds which are otherwise lost from the pulp mill and cause an environmental pollution are recovered as completely as possible.

If, the use of a fresh aqueous alkali, such as aqueous sodium hydroxide and/or aqueous sodium carbonate is intended, this requires additional alkaline material thereby disturbing the chemical balance of the pulp mill. Another disadvantage is that while carbon dioxide is absorbed in such fresh aqueous alkaline solution, absorption of hydrogen sulfide and sulfur dioxide is decreased. Since carbon dioxide is non-pollutant, complete removal of carbon dioxide from the waste gas is a wasteful effort.

At a pH below 9.0 carbon dioxide is not absorbed in an aqueous alkaline solution but hydrogen sulfide and sulfur dioxide are effectively absorbed in the aqueous solution in the presence of a catalytic amount of at least one water soluble iron salt. On the other hand, at a pH below 8.3, sodium carbonate present in green liquor, white liquor and weak white liquor decomposes to liberate carbon dioxide.

Oxidation of green liquor, white liquor and weak white liquor can be carried out by blowing a molecular oxygen-containing gas, preferably air into the liquor to effect conversion of sodium sulfide into sodium thiosulfate and/or sodium sulfate. The temperature at which oxidation is carried out is usually 20° to 95° C. The concentration of sodium ion in the liquor is to be maintained at 0.1 to 1.0 mol/l. By the term "concentration of sodium ion", we mean the concentration of the sum of sodium ions derived from sodium carbonate and sodium bicarbonate present in the liquor. At higher sodium ion concentration, the pH of the solution will exceeds the upper limit to adversely affect the oxidation efficiency and to form precipitation from the dissolved chemicals.

The iron salt which may be used according to this invention includes, for example, ferrous sulfate and ferric sulfate. If a water insoluble iron compound, such as iron oxide and iron hydroxide in the form of a suspension is used, the oxidation efficiency lowers and there is often observed deposition of insoluble iron compound on the inner wall of the apparatus employed, especially on packings in a packed column in which oxidation is conveniently effected. The amount of the iron salt to be present is a catalytic amount which is usually an extremely small amount ranging from 10 to 100 mg/l, in terms of Fe, preferably 10 to 30 mg/l.

If the amount of the iron salt exceeds the upper limit, the formation of insoluble iron hydroxide is often observed.

At the start of the process according to this invention, a carbon dioxide rich waste gas, for example, from a recovery boiler, a kiln calcinating calcium carbonate or a heavy oil boiler and a molecular oxygen-containing gas, preferably air are blown into green liquor, white liquor or weak white liquor containing the iron salt, the pH of the liquor being above 9. Therefore, carbon dioxide in the waste gas is absorbed together with sulfur compounds and water vapor to lower the pH of the liquor and simultaneously dilute the concentration of the sodium ion of the liquor. Once, the pH value has reached 9 or below, carbon dioxide is no longer absorbed. In general, in order to establish the required conditions, about one day will be necessary and, thereafter, steady conditions will be maintained permanently by circulating the liquor to an absorber to which a waste gas is also supplied for absorption of the sulfur compounds and the dust.

A preferred embodiment will be explained referring to the attached FIG. 1 which is a flow-sheet of the process according to this invention.

Wood chips are cooked in a digester with a cooking liquor (white liquor), and cooked chips and the cooking waste liquor are discharged to one or more washers by which pulp and black liquor are separated, the former being subjected to further treatment and the latter being subjected to recovery of useful chemicals. The black liquor is concentrated in one more evaporators and the concentrate is burnt in a recovery boiler to obtain a smelt main components of which are sodium carbonate and sodium sulfide. The smelt is admixed with weak white liquor in a dissolver to form green liquor from which insoluble materials are separated in a clarifier. The clarified green liquor is admixed with aqueous calcium hydroxide in a causticizer to obtain a white liquor main components of which are sodium hydroxide and sodium sulfide. The white liquor is used in the cooking stage after clarification.

Calcium carbonate separated from the causticizer is washed with water, the washings being a weak white liquor. The washed calcium carbonate is calcined in a kiln to obtain calcium oxide which is admixed with water in a slaker to obtain an aqueous calcium hydroxide for use in the causticizer.

The waste gas from the recovery boiler contains hydrogen sulfide, sulfur dioxide and sodium compound dust as valuable chemicals and is subjected to dust collection, preferably in an electric precipitator.

The foregoing is a conventional operation in a pulp mill.

A waste gas containing calcium carbonate dust as well as an extremely small amount of sulfur dioxide discharged from the kiln is introduced into an absorber in which the gas is contacted and washed with an aqueous alkaline solution circulated from an oxidation tank. In the tank, weak white liquor from the washing step and the effluent from the absorber are oxidized by blowing air therein in the presence of a catalytic amount of at least one water soluble iron salt.

A portion of the liquor circulating from the oxidation tank to the absorber is withdrawn and is returned for washing calcium carbonate from the causticizer.

The waste gas from the recovery boiler is supplied to an absorber, preferably in the form of a packed column, in which hydrogen sulfide, sulfur dioxide and sodium compound dust in the waste gas are absorbed in an aqueous alkaline solution circulated from an oxidation tank. In the oxidation tank, the effluent from the absorber and green liquor are subjected to oxidation in the presence of the catalyst by blowing air. A portion of the oxidized liquor circulating to the absorber is withdrawn and is conveniently combined with the black liquor to be subjected to chemical recovery.

Although in this preferred embodiment, the aqueous alkaline solutions derived from the weak white liquor and the green liquor are used for treatment of the kiln waste gas and the recovery boiler waste gas, respectively, an aqueous alkaline solution obtained from any liquor may be used for treatment of either waste gas. In a manner similar to above, a waste gas from a heavy oil boiler may be treated to remove sulfur dioxide therefrom.

This invention will be explained in further detail by means of examples. However, it should be understood that this invention is in no way limited by these examples.

EXAMPLE 1

Green liquor and air were supplied to a vessel containing an extremely large amount of an aqueous alkaline solution having a pH of 8.7, a sodium ion concentration of 0.65 mol/l and a temperature at 70° C. and containing 30 mg/l, in terms of Fe, of ferrous sulfate.

The flow rates of the green liquor and the air were 2.5 l/hr and 5.7 l/min., respectively.

Procedures similar to the above were repeated in the absence of ferrous sulfate.

In the presence of ferrous sulfate, the sodium sulfide in the green liquor was readily oxidized. On the other hand, in the absence of ferrous sulfate, hydrogen sulfide was liberated from the green liquor when air was blown.

EXAMPLE 2

Various iron compounds in an amount listed below were added to an aqueous alkaline solution having a pH of 8.8, a sodium ion concentration of 0.9 mol/l and a temperature of 70° C. Air was blown at a rate of 5.7 l/min. through the solution, while green liquor was introduced. The maximum flow rate of green liquor above which liberation of hydrogen sulfide was detected are given in Table 1.

TABLE 1

| Catalyst | Concentration (mg/l, in terms of Fe) | Flow rate l/hr. |
|---|---|---|
| $FeSO_4$ | 30 | 2.8 |
| $Fe_2O_3$ | 30 | 1.3 |
| $Fe(OH)_3$ | 30 | 1.4 |

From the foregoing, it was understood that with ferrous sulfate as much as two times or more of the green liquor could be oxidized.

EXAMPLE 3

Air was blown at a flow rate of 5.7 l/min. through an aqueous alkaline solutions having a sodium ion concentration of 0.58 mol/l, a concentration of ferrous sulfate of 23 mg/l, in terms of Fe, a temperature of 70° C. and at pH values of 8.7, 9.0, 9.2 and 9.35. The amounts of the green liquor which could be oxidized were determined. The results are illustrated in FIG. 2.

Figure 2:
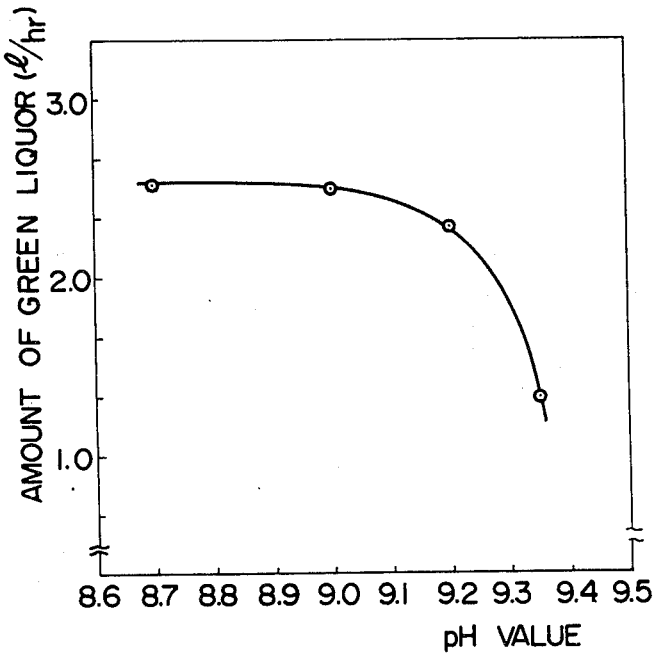

From FIG. 2 it was understood that at a pH above 9.0 the amount of green liquor was decreased.

EXAMPLE 4

In this Example, weak white liquor was oxidized.

Air was blown at a rate of 5.7 l/min. through an aqueous alkaline solution having a pH of 8.8, a sodium ion concentration of 0.6 mol/l, a temperature of 65° to 70° C. and a ferrous sulfate concentration of 30 mg/l, in terms of Fe, while the weak white liquor was supplied.

The flow rate of the weak white liquor which could be oxidized was 12.5 l/hr.

EXAMPLE 5

According to a process illustrated in FIG. 1, a waste gas from a recovery boiler was treated.

The waste gas and green liquor supplied to the oxidation tank and the aqueous alkaline solution supplied to the absorber had the following compositions, respectively.

| | |
|---|---|
| Waste gas | |
| $H_2S$ | 300 ppm |
| $SO_2$ | 300 ppm |
| $CO_2$ | 16% |
| $O_2$ | 4% |
| $H_2O$ | 20% |
| Dust | 0.2 g/Nm$^3$ |
| $N_2$ | Balance |
| Amount | 300 Nm$^3$/hr. |
| Temperature | 130° C. |
| Note. The proportion is by volume. | |
| Green liquor | |
| $Na_2CO_3$ | 1.1 mol/l |
| $Na_2S$ | 0.3 mol/l |
| $Na_2S_2O_3$ | 0.02 mol/l |
| $Na_2SO_3$ | 0.01 mol/l |
| Amount | 5.8 l/hr. |
| Aqueous solution | |
| pH | 8.8 to 9 |
| Sodium ion concentration | 0.5 to 0.7 mol/l |
| $FeSO_4$, in terms of Fe | 30 mg/l |
| Temperature | 70° C. |
| The flow rate of air was 0.9 Nm$^3$/hr. | |

It was found that, at the outlet of the absorber, the exhaust gas contained 0.09 g/Nm$^3$ or less of the dust, 30 ppm or less of hydrogen sulfide and 15 ppm or less of sulfur dioxide.

What is claimed is:

1. In a method for regenerating and recovering pulp mill chemicals which comprises feeding black liquor to a recovery and regeneration operation including a recovery boiler, smelt dissolver for forming green liquor, and causticizer for converting the green liquor into white liquor containing sodium hydroxide and sodium sulfide useful for cooking wood chips, preparing an oxidized liquor by contacting an aqueous alkaline pulp mill liquor selected from the group consisting of green liquor, white liquor and weak white liquor with a gas containing molecular oxygen and absorbing waste gases containing sulfur compounds, carbon dioxide and dust in said oxidized liquor, the improvement comprising (a) contacting said aqueous alkaline pulp mill liquor with said gas containing molecular oxygen while maintaining said aqueous alkaline pulp liquor at a pH of 8.3 to 9.0, a temperature of 20° to 95° C. and a sodium ion concentration, derived from sodium carbonate and sodium bicarbonate in said aqueous alkaline pulp mill liquor, of from 0.1 to 1.0 moles/l, in the presence of from 10 to 100 mg/l of a catalyst consisting of at least one water-soluble iron salt, (b) absorbing the sulfur compounds including hydrogen sulfide and sulfur dioxide, and dust in said waste gases with said oxidized liquor containing said water soluble catalyst without substantial absorption of carbon dioxide in said oxidized liquor while the pH of said oxidized liquor is maintained between 8.3 and 9.0, (c) recirculating a portion of the oxidized liquor from step (a) to the black liquor, while (d) recirculating the liquor from the gas absorption step (b) to the oxidation step (a).

2. A process for recovery of pulp mill chemicals according to claim 1, wherein the amount of said water soluble iron salt is from 10 to 30 mg/l, in terms of Fe.

3. A process for recovery of pulp mill chemicals according to claim 1, wherein said water soluble iron salt is at least one of ferrous sulfate and ferric sulfate.

4. A process for recovery of pulp mill chemicals according to claim 1, wherein said waste gas is from a recovery boiler or a kiln for calcining calcium carbonate from the causticizer of the pulp mill.

5. A process for recovery of pulp mill chemicals according to claim 1, wherein said aqueous alkaline solution of step (a) is obtained from green liquor and said waste gas of step (b) is from a recovery boiler.

6. A process for recovery of pulp mill chemicals according to claim 1, wherein said aqueous alkaline solution of step (a) is obtained from weak white liquor and said waste gas of step (b) is from a kiln calcining calcium carbonate.

7. A process for recovery of pulp mill chemicals according to claim 1, wherein said aqueous alkaline solution of step (a) is obtained from weak white liquor, said waste gas of step (b) is from a kiln calcining calcium carbonate and a portion of said liquor from step (a) is combined with weak white liquor.

8. A process for recovery of pulp mill chemicals according to claim 1, incorporating the additional step of initially establishing said pH of said aqueous alkaline solution in step (a) by blowing a carbon dioxide rich waste gas and a molecular oxygen-containing gas through at least one aqueous alkaline pulp mill liquor selected from the group consisting of green liquor, white liquor and weak white liquor, said liquor containing a catalyst consisting of a water soluble iron salt, until absorption of carbon dioxide ceases.

9. The process of claim 1, wherein in step (b) said absorption of waste gases takes place in a packed column.

10. The process of claim 1, wherein in step (a) said contacting of aqueous alkaline pulp mill liquor with said gas containing molecular oxygen takes place in a packed column.

* * * * *